United States Patent [19]

Doyle

[11] Patent Number: 4,959,946

[45] Date of Patent: Oct. 2, 1990

[54] FILM WRAPPED RECEPTACLE

[75] Inventor: Joseph S. Doyle, Williamsburg, Va.

[73] Assignee: Eastern Shore Printing Corp., Ashland, Va.

[21] Appl. No.: 407,530

[22] Filed: Sep. 15, 1989

Related U.S. Application Data

[63] Continuation-in-part of Ser. No. 207,178, Jun. 15, 1988, abandoned.

[51] Int. Cl.[5] ..... B65B 53/02; B65B 51/04

[52] U.S. Cl. ..... 53/415; 53/416; 53/442

[58] Field of Search ..... 53/416, 415, 442, 482, 53/481, 480, 477, 476

[56] References Cited

U.S. PATENT DOCUMENTS

| | | | |
|---|---|---|---|
| 1,640,052 | 12/1925 | Olsen, Jr. . | |
| 2,125,833 | 11/1934 | Dowling . | |
| 2,809,896 | 6/1957 | Pierson et al. . | |
| 2,829,791 | 4/1958 | Berst | 53/442 X |
| 2,876,114 | 3/1959 | Robertson et al. . | |
| 2,893,877 | 7/1959 | Nickolls | 220/449 X |
| 3,027,997 | 4/1962 | Reifers | 206/45.33 |
| 3,522,688 | 8/1970 | Kaliwoda | 53/442 |
| 3,895,120 | 7/1975 | Backus | 426/396 |
| 4,173,655 | 11/1979 | Capo | 426/129 |
| 4,275,811 | 6/1981 | Miller | 206/204 |
| 4,321,997 | 3/1982 | Miller | 206/204 |
| 4,410,578 | 10/1983 | Miller | 428/117 |
| 4,535,587 | 8/1985 | Rias | 53/442 X |
| 4,641,488 | 2/1987 | Garr | 53/442 |
| 4,666,079 | 5/1987 | Bolli et al. | 229/87 F |
| 4,683,139 | 7/1987 | Cheng | 426/265 |
| 4,763,783 | 8/1988 | Talbot | 53/442 X |

FOREIGN PATENT DOCUMENTS

| | | | |
|---|---|---|---|
| 29865 | of 1914 | United Kingdom | 426/106 |

*Primary Examiner*—James F. Coan
*Attorney, Agent, or Firm*—Hoffmann & Baron

[57] ABSTRACT

A receptacle for food products and the like is provided. A plastic film is tightly wrapped about a preformed package such as a tray containing wet food products. The film defines a pair of opposing flaps and an area of overlapping film portions extending between the flaps and adjacent to the bottom surface of the tray. Heat and pressure are applied to the wrapping at the bottom surface of the tray to provide a flat, sealed film surface. A strip of adhesive tape is applied to the flat film surface, thereby connecting the opposing flaps and providing a seal over the seam defined by the overlapping film portions. The tape is then heated to cause the adhesive to flow, thereby improving the seal. The wrapping is prevented from moving from its original position by the tape and is accordingly substantially leak-proof.

13 Claims, 2 Drawing Sheets

FILM WRAPPED RECEPTACLE

CROSS-REFERENCE TO RELATED APPLICATION

This application is a continuation-in-part of application Ser. No. 207,178 filed June 15, 1988 now abandoned.

BACKGROUND OF THE INVENTION

The invention relates to a receptacle for poultry and the like including a tray or other container and a film wrapping which is positioned over the container and its contents and sealed beneath the container.

Pre-packaged poultry, poultry parts and other food products have been provided in a receptacle including a tray and a flexible thermoplastic film wrapping. The tray may be made from materials such as cardboard or styrofoam while the wrapping may be a PVC stretch film, polyethylene film, coextruded polyethylene/polypropylene film or other suitable material. PVC film has emerged as the predominant overwrap used in the industry because of its machinability on automatic equipment, the ease in which it can be formed and folded for heat sealing beneath the tray, and its memory and clarity.

Automatic packaging machinery typically employ stretch, stretch and shrink, or shrink techniques combined with heat and pressure to seal the lap areas of plastic films wrapped tightly about the tray and its contents. Such equipment is generally referred to as stretch and/or shrink wrapping machinery.

Some plastic films will, under heat, pressure and sufficient dwell time, melt together and conform to the package profile, but generally do not actually form a true surface to surface seal. Rough handling in packing and/or transportation may cause "capillary" leakage in those areas not conformed perfectly to the package.

The sealing characteristics of PVC overwrap films have never been completely satisfactory, and the problems of leaking packages having poor seals have become exacerbated during recent years with the advent of volume markets and the increase in shipping distances. The problem has lately become so evident that some supermarket chains have been supplying paper towels and/or plastic bags at the pre-packaged poultry display cases.

Coextruded films with sufficient memory for this type of packaging, such as are available to the food packaging industry, seal well under optimal conditions, but such conditions are not always possible, particularly where packaging fresh food products is concerned. Inconsistencies in the film itself may also result in leakage due to unsatisfactory sealing.

The product to be packaged may also create problems peculiar thereto in allowing a good seal to be created. For example, poultry products have irregular configurations, and the sizes thereof can vary greatly. This makes it very difficult to determine the correct amount of film required for proper wrapping and sealing. Automatic packaging systems do not ordinarily lend themselves to such adjustments.

The use of an excessive amount of film creates an insulating effect which leads to poor package conformation and sealing. To compensate for the poorer seal, the heat sealing belt temperature may be raised, but often with a "burn through" problem resulting therefrom.

Too little film results in an insufficient contact area for proper sealing.

Other variables, such as variations in the size and volume per package, the temperature of the product to be packaged, and the packaging rate affect the temperature of the heat sealing belt, the pressure applied to the lap seal of the film wrapping, and the dwell time upon the heat sealing surface. The seals provided on each package accordingly may not be consistent, resulting in leakage.

A wrapping/sealing system known to the art includes a feeding belt, a wrapping machine, and a heat seal belt. A pressure unit may also be provided. Trays including poultry parts are hand fed to the feeding belt which conveys them to the wrapping machine. The wrapped, unsealed trays are ejected onto a moving heat seal belt which attempts to provide a heat seal in the areas of the flaps and lap area of the wrapping beneath the tray. Simultaneously, the trays may or may not be under pressure to improve the seal. A cooling unit may be associated with the pressure unit to help set the seal. The sealed package is then ready for packing in shipping containers and transported to the market.

One wrapping apparatus heat seals the sides of the wrapping film by drawing the lap areas together under the tray into a heated sealing wheel that provides the heat, dwell time and pressure required to form a substantially leak-proof, center sealed seam, but a sealing belt is still required to seal the front and rear flaps that fold beneath the tray.

A number of attempts have been made to improve the seal areas of film-wrapped packages. Many of these attempts have focussed on improving the sealing properties of the film itself. The films available to the food-packaging industry do not, however, provide consistently satisfactory sealing using conventional heat sealing techniques.

Other approaches for enhancing the sealing capability of plastic films has been to print adhesive directly on to the tray or to the film itself in the areas where the flaps and lap areas are to be formed. These approaches have been unsuccessful. In fact, such additions of adhesive may even interfere with the formation of a more permanent seal of the film layers by providing unwanted insulation, thereby preventing the even conduction of heat among the layers from the heat belt.

Heat sealing apparatus have been redesigned to improve their ability to seal thermoplastic films. Investments in such apparatus require significant capital, however, and still do not entirely solve problems related to leakage. Some of the more modern apparatus are energy intensive, which leads to higher operating costs as well.

Because of the inability of the industry to develop a satisfactory seal in a package including a tray and a film overwrap, several absorbent, padded trays have been proposed for absorbing fluids before they can leak through the sealed areas of the overwrap film. Chambered trays have also been proposed for trapping such fluid.

There has accordingly been a long felt need for a film-wrapped package which includes substantially leak-proof seals in the flaps and/or lap areas formed by the film, particularly a package which can be assembled using existing wrapping equipment without making substantial capital investments thereto or greatly increasing operating costs.

SUMMARY OF THE INVENTION

It is an object of the invention to provide a substantially leak-proof, film-wrapped package which can be manufactured without significantly modifying existing apparatus for packaging food products and the like.

It is another object of the invention to provide a method for sealing a film wrapping in a reliable manner under a variety of different conditions.

In accordance with these and other objects of the invention, a receptacle is provided including a film wrapping and an adhesive-backed tape or the like which adheres to the wrapping film in the areas where leakage is likely to occur. The wrapping preferably includes a pair of opposing flaps which adjoin a lap area extending therebetween. The adhesive-backed tape is applied so as to adhere to both flaps and at least a portion of the lap area. It is also positioned to restrict the movement of the creases and folds of the film wrapping, which is a major cause of leakage. While one strip of tape is preferably employed to seal both flaps and the lap area, separate strips may be utilized, one for each flap.

The method according to the invention may be practiced by introducing an automatic package taping machine in line after a film wrapping apparatus such as a stretch wrapping machine. Heating means may be provided between the wrapping assembly of the wrapping apparatus and the taping machine, preferably in the form of a heating belt, in order to provide better flatness to the lap area and conformity to the shape of the underlying container, such as a tray. This allows superior seal adhesion to be provided between the wrapping film and the adhesive surface of the tape. The adhesive tape is preferably applied immediately after the heating step, which is the point in time when the seals defined by the film itself are at their best. A second heating step is preferably performed after application of the tape to allow the adhesive to flow into the areas requiring sealing. A leak-proof seal is accordingly provided.

DETAILED DESCRIPTION OF THE INVENTION

Figure 1:
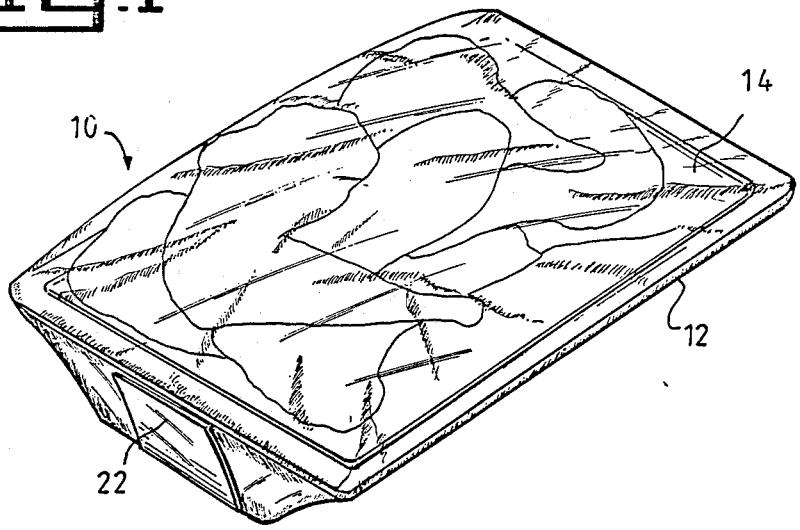
FIG. 1 is a top perspective view of a wrapped food products tray according to the invention.
Figure 2:
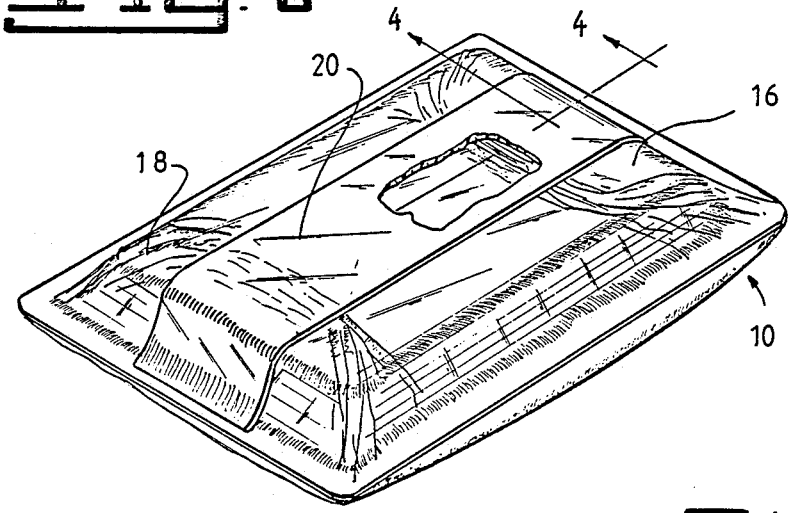
FIG. 2 is a bottom perspective view thereof.
Figure 3:
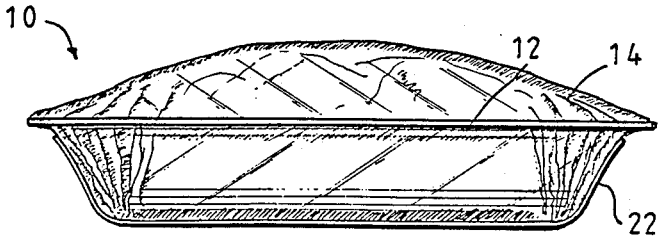
FIG. 3 is a side elevation view thereof.
Figure 4:
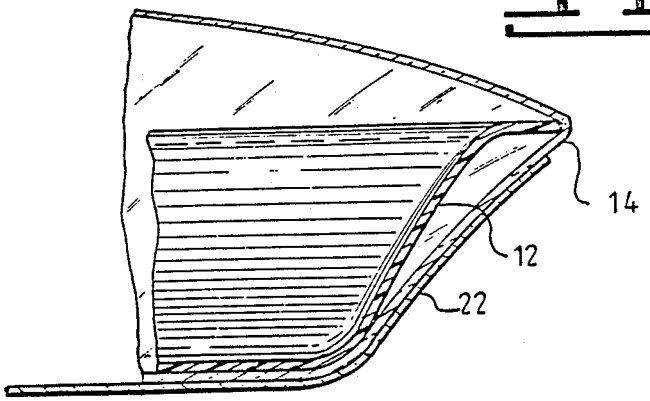
FIG. 4 is a sectional elevation view of the embodiment of the invention shown in FIGS. 1–3, taken along the section line shown in FIG. 2.

A film wrapped receptacle 10 as shown in FIGS. 1–4 is provided by the invention. The receptacle includes a preformed package such as a tray 12 having a clear, flexible, plastic film wrapping 14. Referring to FIG. 2, the wrapping includes a pair of opposing front and rear flaps 16, 18 and a lap seal area 20 extending between the flaps. As shown in FIG. 3, the wrapping has been flattened or compressed at the bottom of the tray and substantially conforms to the flat bottom surface thereof. The overlap of the film in the lap seal area is ordinarily between one half and three inches. Each end of the wrapping (i.e., the flaps) may fold upon itself a number of times, which is one of the factors which leads to sealing difficulties using conventional sealing techniques. The amount of such excess material is a function of the amount of film employed per receptacle, the size of the receptacle, and the capability of the wrapper or wrapping machine to distribute the film evenly rather than "bunching" excess folds. Since this size may vary depending upon the contents therein, the amount of wrapping film used must be sufficient to enclose the largest anticipated size in the run. More folds or wrinkles will accordingly be formed in the packages where the volume or size of the contents is reduced.

A clear, plastic, box-sealing, water-impermeable adhesive tape 22 is adhered to the flat surface defined by the film wrapping 14 beneath the tray. The tape extends across a portion of each flap 16, 18 and the lap seal area 20 between the flaps. A sealing adhesion is provided between the film wrapping and the adhesive surface of the tape. An adhesive tape approved for use in meat and poultry packaging, with substantially the same specification as that sold by the Minnesota Mining & Manufacturing Company under product number 371, and the trademark HIGHLAND, has been found to provide satisfactory adhesion to the plastic films used for wrapping food products such as beef and poultry. Other tapes or patches having similar adhesive properties, sufficient strength and water impermeability could alternatively be employed. The tape need not be transparent.

The receptacle shown in FIGS. 1–4 has been found to provide sufficient protection against leakage when used as a receptacle for poultry and subjected to normal handling procedures for such items. The film wrapping is held in place in the same conformation with the tray surface as originally wrapped, thus preventing movement of the wrapping with respect to either the tray or itself, and consequential leakage.

Figure 5:
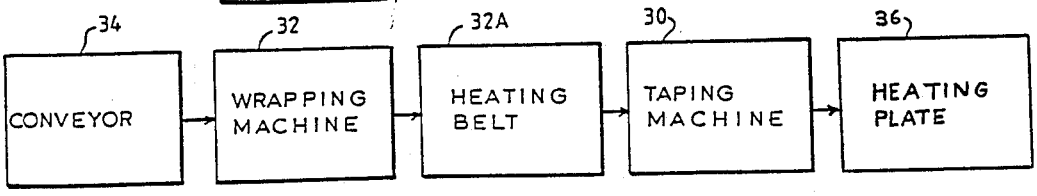
FIG. 5 is a schematic illustration of an assembly for providing a wrapped and taped receptacle.

As shown in FIG. 5, an automatic package taping machine 30 is provided in series with a stretch wrapping machine 32 and a conveyor 34. The taping machine has the ability to apply lengths of tape to the lap areas at the bottoms of the trays at a rate of up to sixty packages per minute. The conveyor 34 transports unwrapped trays of food products to the wrapping machine 32 which applies a plastic film wrapping as described above. The tray then moves a short distance upon a heating belt 32A from where it enters the taping machine 30. The heating belt helps to insure that the wrapping film will be sufficiently flat against the tray to allow complete adhesion between the film and tape adhesive surfaces, and may provide at least partial heat sealing of the flaps and lap area. The tape applied adheres to the lap area and the opposing front and rear flaps of the film wrapping. It may extend as far as the top of the tray on both sides thereof. The tape is preferably between two and four inches wide. In this manner, the two areas of the wrapping film most likely to cause leakage problems, i.e., the front and rear flaps 16, 18 and the center lap seal defined by the overlapping of the side flaps of the wrapping, are effectively sealed. Since movement of the film wrapping is effectively precluded by the strip (or strips) of tape, leaks are unlikely to develop during handling and shipping. As a final step, the taped area is heated by a heating belt or plate 36 to allow the adhesive to flow into the folds or wrinkles which characterize film-wrapped packages. The belt or plate is pressed against the taped surface at a temperature of about 150° F. or more, depending upon the materials which comprise the tape and film and the flowability of the adhesive. The result is a substantially leak-proof package which can be safely handled and transported.

The taping machine 30 employed in the process resembles box taping machinery, except the drive belts are relatively lower to facilitate driving the trays without flipping them over and the tape tabs are shorter. It is positioned to apply the tape as soon as the trays exit the heating belt, the point at which the film is best sealed to itself and conformed to the bottom surface of the tray. The tape serves to maintain the seals and the conformity of the wrapping to the tray bottom.

The invention provides a number of significant advantages over conventional film-wrapped packages and assemblies for sealing such packages. Since the seals provided in accordance with the invention are substantially leak-proof, the number of rejected packages requiring rewrapping is significantly reduced. The heat sealing process may be conducted at temperatures which substantially preclude the possibility of "burn through" as the importance of this process in providing a leak-proof seal is greatly diminished, and can possibly be eliminated in certain applications. The above advantages are provided with only a small capital investment. Operating costs, even including the additional expense for tape or other adhesive-backed, flexible members, are reduced due to the reduction in defects.

What is claimed is:

1. A method for wrapping and sealing a preformed package having at least one substantially flat surface, comprising:

tightly wrapping a flexible, plastic film about said preformed package such that said film defines a pair of opposing flaps and a lap area extending between said flaps, said flaps and said lap area being formed adjacent to said substantially flat surface of said preformed package, and said film being folded upon itself a number of times in the area of said flaps, thereby forming a substantial number of wrinkles;

applying heat and pressure to said flaps and lap area of said film, thereby flattening said flaps and lap area into conformity with said substantially flat surface of said preformed package;

applying a strip of adhesive tape to said film such that said strip connects said flaps to each other and overlies said lap area, thereby restricting movement of said film with respect to either said preformed package or to itself, and applying heat to said strip of adhesive tape, thereby causing at least some of said adhesive to flow towards said film and into at least some of said wrinkles.

2. A method as defined in claim 1 wherein said strip of adhesive tape is applied immediately after applying heat and pressure to said flaps and lap area of said film.

3. A method as defined in claim 1 wherein said film is a polyvinylchloride film.

4. A method as defined in claim 1 wherein said step of applying heat to said strip of adhesive tape includes the step of pressing a heated member against said tape.

5. A method for wrapping and sealing a preformed package having at least one substantially flat surface, comprising:

tightly wrapping a flexible, plastic film about said preformed package such that said film defines a pair of opposing flaps and a lap area extending between said flaps, said flaps and said lap area being formed adjacent to said substantially flat surface of said preformed package;

passing said preformed package over a heating belt, thereby applying heat and pressure to said flaps and lap area of said film, and thereby flattening said flaps and lap area into conformity with said substantially flat surface of said preformed package;

applying a strip of adhesive tape to said film such that said strip connects said flaps to each other and overlies said lap area, thereby restricting movement of said film with respect to either said preformed package or to itself, and applying heat to said strip of adhesive tape, thereby causing at least some of said adhesive to flow towards said film.

6. A method as defined in claim 16 wherein said film is a polyvinylchloride film.

7. A method for wrapping and sealing a tray having at least one substantially flat surface, comprising:

tightly wrapping a flexible, plastic film about said tray such that said film defines a pair of opposing flaps and a lap area extending between said flaps, said flaps and said lap area being formed adjacent to said substantially flat surface of said tray;

applying heat and pressure to said flaps and lap area of said film, thereby flattening said flaps and lap area into conformity with said substantially flat surface of said tray;

applying a strip of adhesive tape to said film such that said strip connects said flaps to each other and overlies said lap area, thereby restricting movement of said film with respect to either said tray or to itself, and applying heat to said strip of adhesive tape, thereby causing at least some of said adhesive to flow towards said film.

8. A method as defined in claim 7 wherein said film is a polyvinylchloride film.

9. A method as defined in claim 8 including the step of introducing fresh poultry products into said tray prior to wrapping said tray.

10. A method as defined in claim 7 wherein said step of applying heat to said strip of adhesive tape includes the step of pressing a heated member against said tape.

11. A method as defined in claim 7 including the step of introducing fresh poultry products into said tray.

12. A method as defined in claim 7 wherein said opposing flaps and lap area adjoin the bottom of said tray.

13. A method as defined in claim 12 wherein said film is applied in such a manner that it forms a substantial number of wrinkles adjacent the bottom of said tray, said adhesive being flowed into at least some of said wrinkles upon the application of heat to said strip of adhesive tape.

* * * * *